US006068254A

United States Patent [19]

Olexy

[11] Patent Number: 6,068,254

[45] Date of Patent: May 30, 2000

[54] MULTIPLE FILM SHEET DETECTOR

[75] Inventor: Anthony M. Olexy, Honeoye Falls, N.Y.

[73] Assignee: Eastman Kodak Company, Rochester, N.Y.

[21] Appl. No.: 08/976,855

[22] Filed: Nov. 24, 1997

[51] Int. Cl.[7] ..... B65H 3/46; B65H 7/12; B65H 7/02

[52] U.S. Cl. ..... 271/106; 271/263; 271/265.04

[58] Field of Search ..... 271/11, 262, 263 C, 271/106, 265.04 C

[56] References Cited

U.S. PATENT DOCUMENTS

| | | | |
|---|---|---|---|
| 3,744,787 | 7/1973 | Morrison | 270/56 X |
| 4,462,585 | 7/1984 | Gieson et al. | 271/11 X |
| 4,531,726 | 7/1985 | Bornstein | 271/263 |
| 4,533,133 | 8/1985 | Hams | 271/9 X |
| 5,303,912 | 4/1994 | Blank et al. . | |
| 5,348,286 | 9/1994 | Buck | 271/263 |
| 5,647,583 | 7/1997 | Emigh et al. | 270/52.04 X |

FOREIGN PATENT DOCUMENTS 3705851 2/1987 Germany .

*Primary Examiner*—Christopher P. Ellis
*Assistant Examiner*—Kenneth W. Bower
*Attorney, Agent, or Firm*—William F. Noval

[57] ABSTRACT

Film sheet handling apparatus includes a mechanism for removing a film sheet from a film sheet stack by bending a front area of the top film sheet and then removing the top film sheet from the stack. A multiple sheet detector includes a pair of jaws mounted at the free end of the rotatable lever. The jaws are spaced apart a fixed distance which will allow a single film sheet but not multiple film sheets to slide between the jaws. The lever is rotated so that the jaws are moved into the bent front area of the top film sheet while it is still located on the stack. The film sheet is allowed to slide between the jaws if a single film sheet is separated, so that the lever and jaws are rotated to a first position. The jaws are blocked if multiple sheets are contacted, so that the lever and jaws are rotated to a second position in advanced of the first position. A sensor assembly is stationarely mounted relative to the lever and jaws and selectively senses whether the lever and jaws are at the first or second positions to indicate whether a single or multiple film sheets been separated, respectively.

4 Claims, 14 Drawing Sheets

MULTIPLE FILM SHEET DETECTOR

FIELD OF THE INVENTION

This invention relates in general to multiple sheet detectors and more particularly to a detector for detecting multiple film sheets as a film sheet is being separated from a stack of film sheets.

BACKGROUND OF THE INVENTION

In radiographic laser printers, an unexposed radiographic film sheet is removed from a stack of film sheets and transported to an exposure station where it is exposed by a laser to a radiographic image. The unexposed film sheets are contained in a light tight magazine or cartridge which is opened when a film sheet is to be removed. Multiple film sheets positioned in a stack can present significant difficulties to mechanisms designed to remove a single sheet of film from the stack. Film sheets tend to stick together due to the bonding forces which exist between adjacent sheets of film.

German Offenlegungsschrift DE 3705851, filed Feb. 24, 1987, published Sep. 1, 1988, entitled "Automatische Filmeinlegevorrichtung fur Blattfilm-Kassetten", discloses a multiple sheet detector which detects the film sheet(s) after it is removed from a film sheet stack. If multiple sheets are detected, the sheets are returned to the film stack and the sheet removal process is repeated. The process is repeated until a single sheet is removed. This technique is disadvantageous because the repeated complete removal of the sheets from the stack can cause undesirable damage to the sheets.

U.S. Pat. No. 5,303,912, issued Apr. 19, 1994, inventors Blank et al., discloses an improved device for detecting double film sheets, in which double sheet detection is effected while the film sheet is still on the film sheet stack. While the top film sheet is bent in a front area and before the film sheet is removed, a double sheet detector is rotated into contact with the bent film sheet(s). The detector includes two levers which are pivotally mounted relative to each other and also with respect to the film sheet removal assembly. A multiple sheet sensor is mounted on the pivotable levers, which results in electrical conductors connected to the sensor to be continually flexed as the detector is rotated. Although this design may have been useful for its intended purpose, difficulties have arisen in installation and adjustment of the pivotally mounted levers and in failure of the repetitively flexed sensor electrical conductors.

SUMMARY OF THE INVENTION

According to the present invention there is provided a solution to the problems discussed above.

According to a feature of the present invention there is provided film sheet handling apparatus comprising: means for removing a film sheet from a film sheet stack by bending a front area of the top film sheet and then removing the top film sheet from the stack; a pair of multiple sheet detector jaws mounted at the free end of a rotatable lever, said jaws being spaced apart a fixed distance which will allow a single film sheet but not multiple film sheets to slide between said jaws; means for rotating said lever so that said jaws are moved into the bent front area of the top film sheet while the film sheet is still located on said stack, allowing said film sheet to slide between said jaws if a single film sheet is separated so that said lever and jaws are rotated to a first position, and blocking said jaws if multiple film sheets are contacted, so that said lever and jaws are rotated to a second position in advance of said first position; and a sensor assembly, which is stationarily mounted relative to said lever and said jaws, for selectively sensing whether said lever and jaws are rotated to said first position to indicate that a single film sheet has been separated, or to said second position to indicate that more than a single film sheet has been separated.

ADVANTAGEOUS EFFECT OF THE INVENTION

The invention has the following advantages.

1. The multiple sheet detector is simple, low cost, reliable, and efficient.

2. Delicate adjustments which are prone to change over time are eliminated.

3. Frequent failures caused by flexing electrical conductors connected to a sensor mounted to a rotating lever are eliminated.

DETAILED DESCRIPTION OF THE INVENTION

Figure 14:
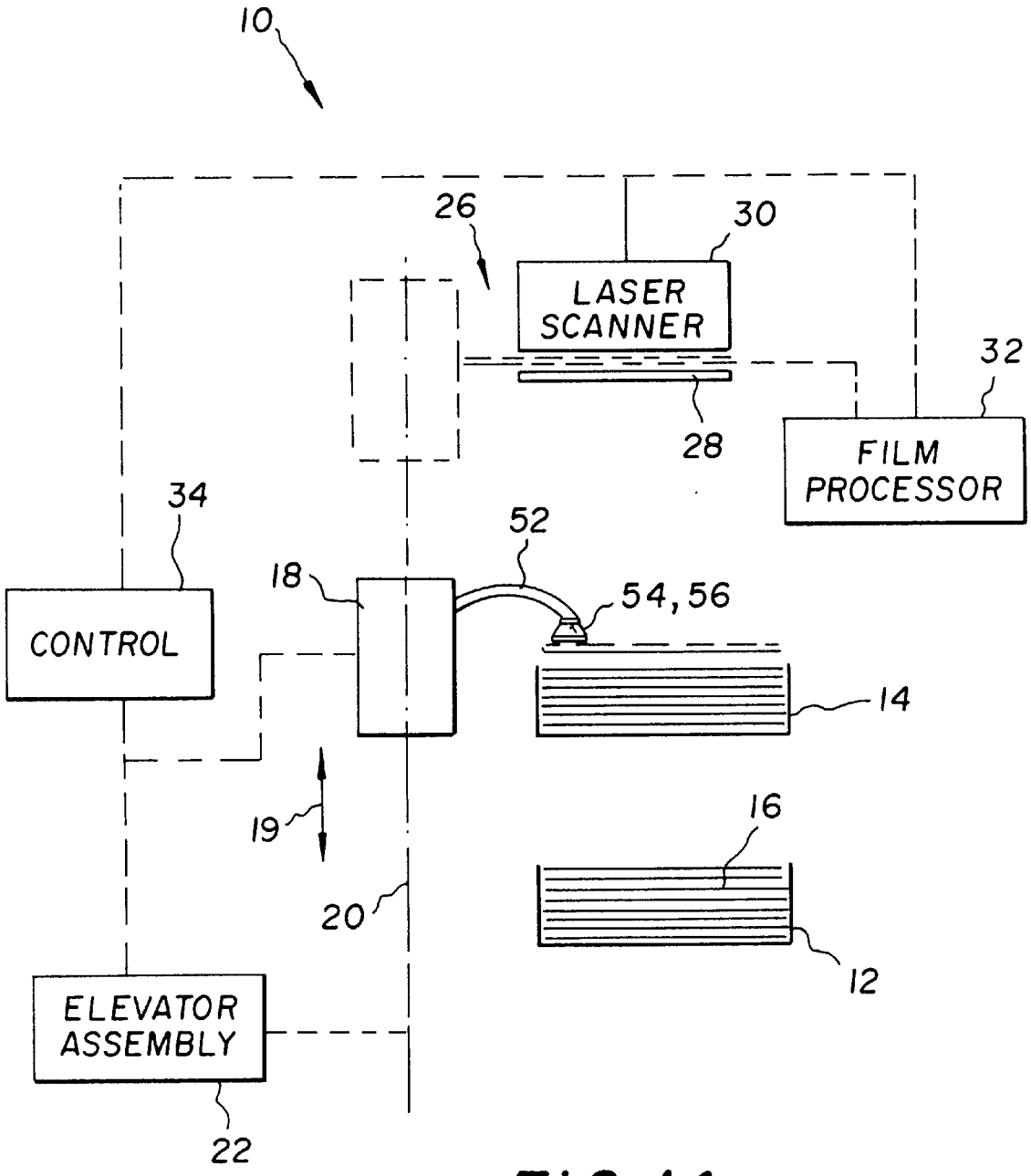
FIG. 14 is a diagrammatic view of radiographic laser imaging apparatus incorporating the present invention.

Referring now to FIG. 14, there is shown radiographic laser imaging apparatus incorporating the present invention. As shown, radiographic laser imaging apparatus 10 includes film sheet supplies 12 and 14 containing stacks of unexposed radiographic film sheets 16. Supplies 12 and 14 can be light tight cartridges or magazines containing film sheets of the same or different sizes or the same or different film characteristics. An elevator and film sheet picker assembly 18 is driven in opposite vertical directions 19 on vertical guide 20 by elevator assembly 22. Assembly 18 includes a sheet picker 52 with suction cups 54. As will be described in more detail later, assembly 18 is driven to a supply 12,14, where picker 52 is rotated to bring suction cups 54 into contact with a top film sheet 16 for removal from the film sheet stack. After a single film sheet 16 has been removed, assembly 18 is driven to exposure station 26 where film sheet 16 is delivered to exposure platen 28. Laser scanner 30 exposes the unexposed film sheet to a radiographic image.

The exposed film sheet 16 is delivered to film processor 32 which processes the film sheet 16 to produce a developed radiographic film. Depending upon the type of film used, processor 32 can be either a wet or dry film processor.

Control 34 controls the operation of all of the components of apparatus 10, including elevator guide 20, elevator and picker assemblies 18,22, laser scanner 30, and film processor 32.

Referring now to FIGS. 1–5, there will be described in greater detail the film sheet picker assembly 18. As shown, assembly 18 includes a frame 40 which supports a film sheet picker assembly 42, a multiple sheet detector 44, and an air mover 46. Assembly 42 includes member 48, mounted at one end on shaft 50, and at the other end mounting U-shaped member 52. Member 52 has arms 53 supporting suction cups 54 by means of shaft 56 extending between arms 53, rocker member 58,60 mounted on shaft 56, plenum member 62 supporting cups 54 mounted on one side of rocker members 58,60 and rollers 64 mounted on shaft 66 on the other side of rocker members 58,60. Suction cups 54 are supplied a vacuum by way of plenum member 62 and vacuum conduit 68. Springs 69 bias cups 54 in a clockwise direction 57 (FIG. 5) about shaft 56.

A motor 78 mounted on frame 40 drives picker arm assembly 42 by means of belt 80 trained about sprocket 82 on shaft 50.

Multiple sheet detector 44 is journaled on shaft 50 and includes jaws 84 and 86 mounted at the end of lever 88. Jaws 84 and 86 have a space 90 between them which allows the passage of a single film sheet but which blocks the passage of more than one film sheet. The space has a dimension which is slightly greater than the thickness of one sheet of film but which is less than the thickness of two sheets of film. Detector 44 is biased in the direction of arrow 92 by spring 94. Solenoid 96 with pin 98 holds detector 44 against the bias of spring 94. Detector 44 has an interrupter member 100 which cooperates with photosensor 102 (see FIGS. 2, 12, and 13) mounted on frame 40 to detect single or multiple sheets (as will be explained later).

Air mover 46 is fixedly mounted on frame 40 and includes a fan 110 (FIG. 12) which moves air through chamber 112 out nozzle 114 to facilitate separation of a film sheet from its stack.

A top of film sensor 116 cooperates with linkage 118 on member 52 to indicate contact of the suction cups 54 with the top film sheet in a stack.

The operation of film sheet picker arm assembly 42, multiple sheet detector 44, and air mover 46 will now be described with particular reference to FIGS. 6–13, but also with reference to the other figures.

Figure 1:
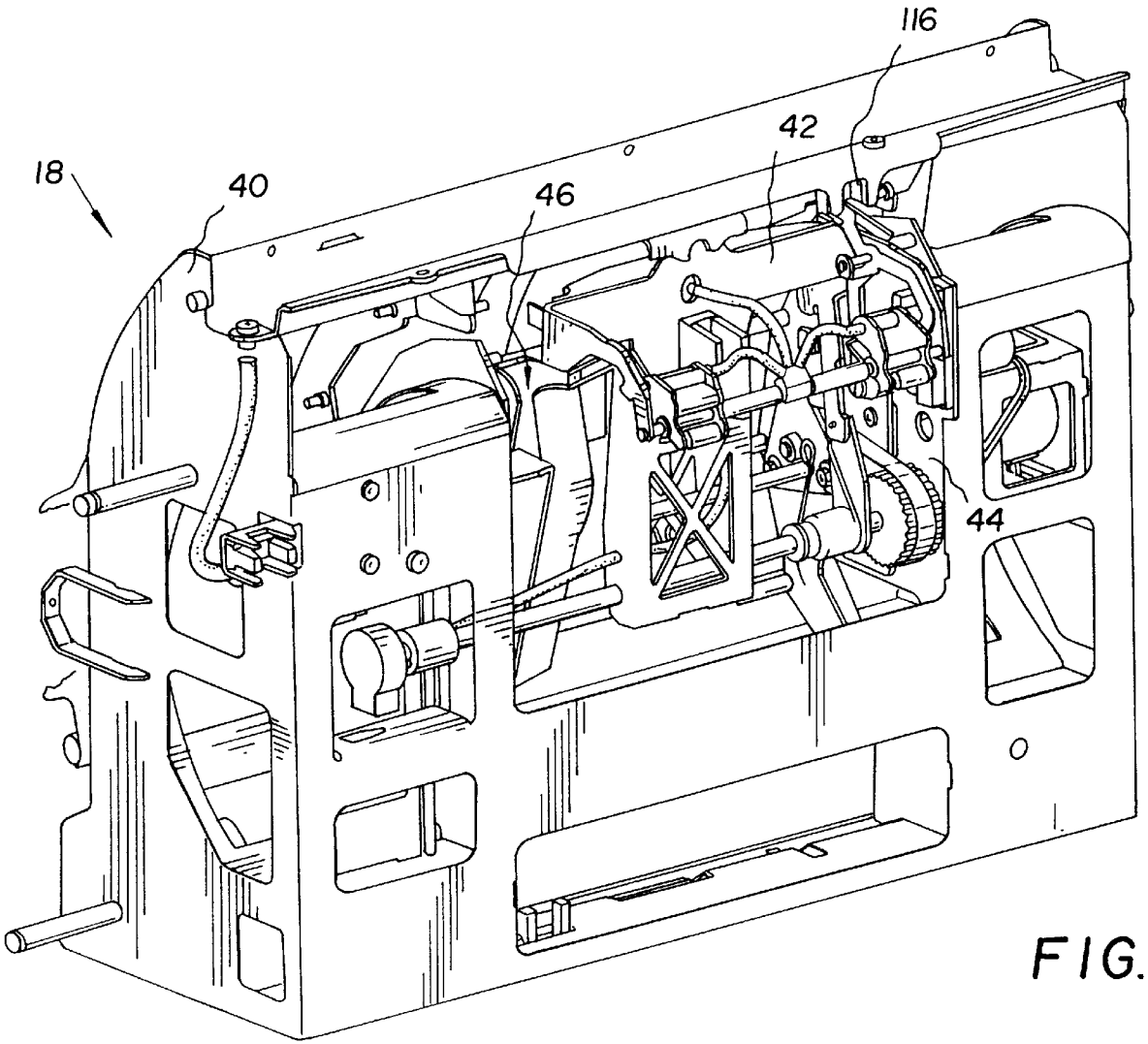
FIGS. 1 and 2 are perspective views of film sheet handling apparatus incorporating the present invention.
Figure 2:
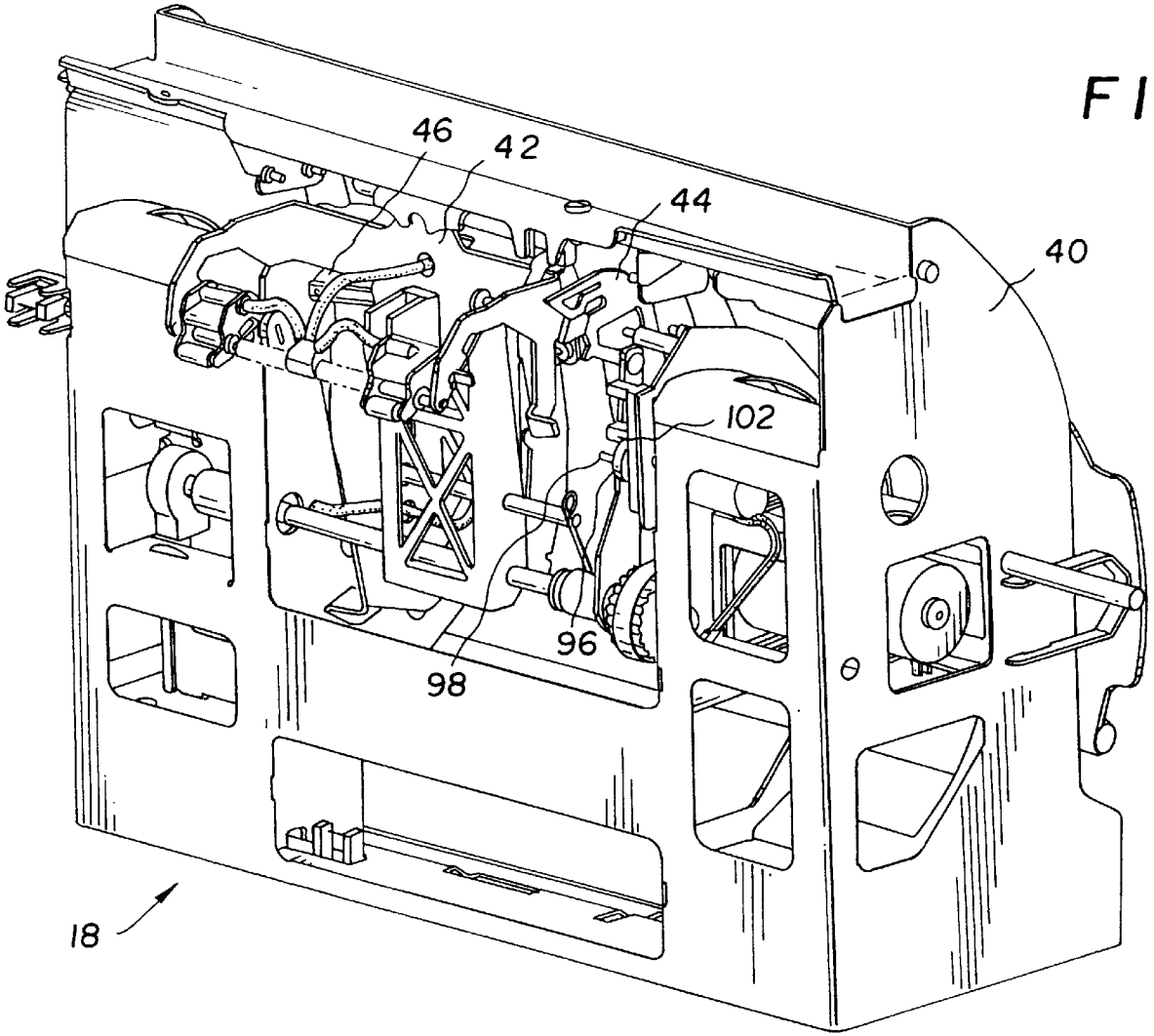
Figure 3:
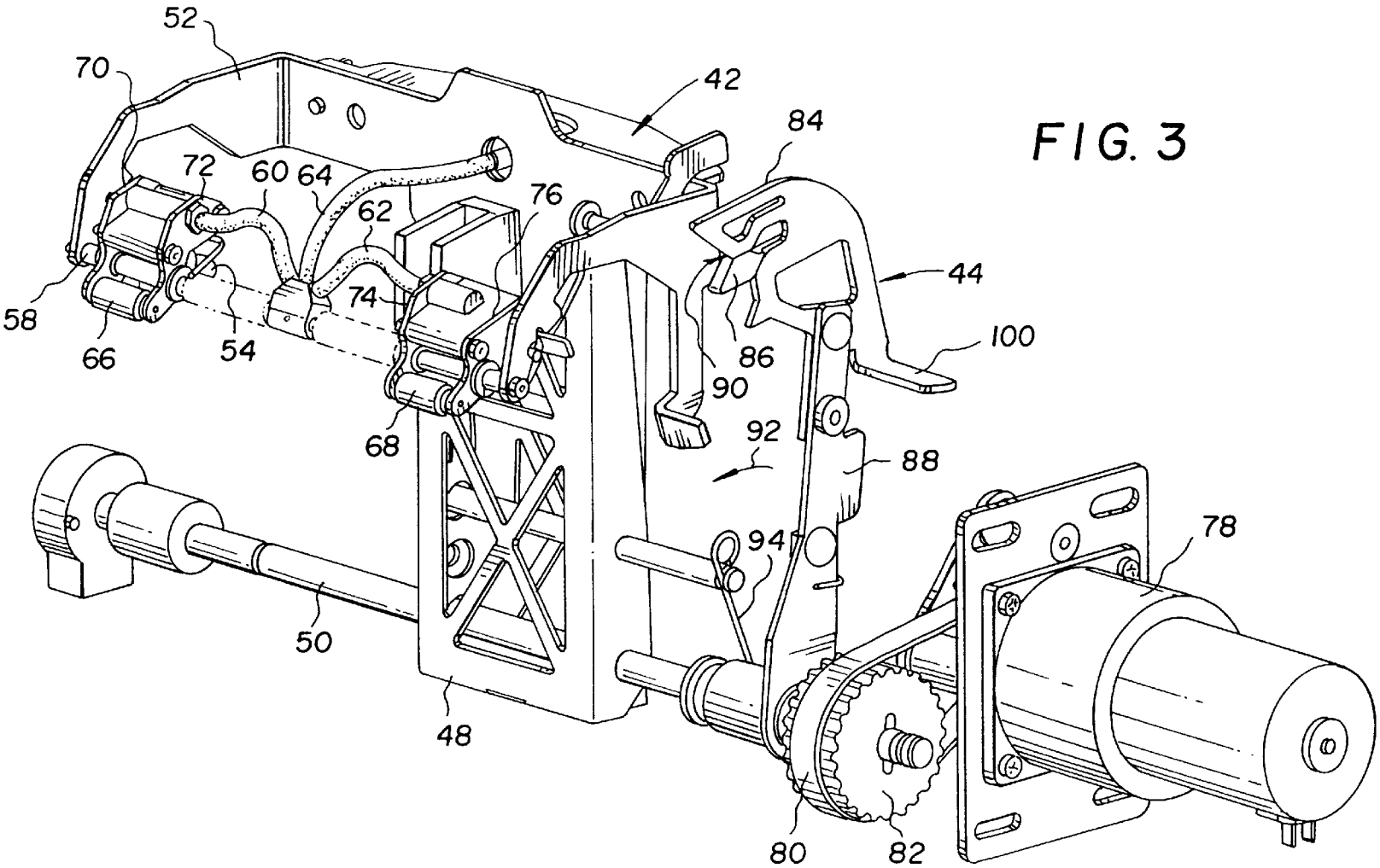
FIGS. 3–5 are perspective views of components of the apparatus of FIGS. 1 and 2.
Figure 4:
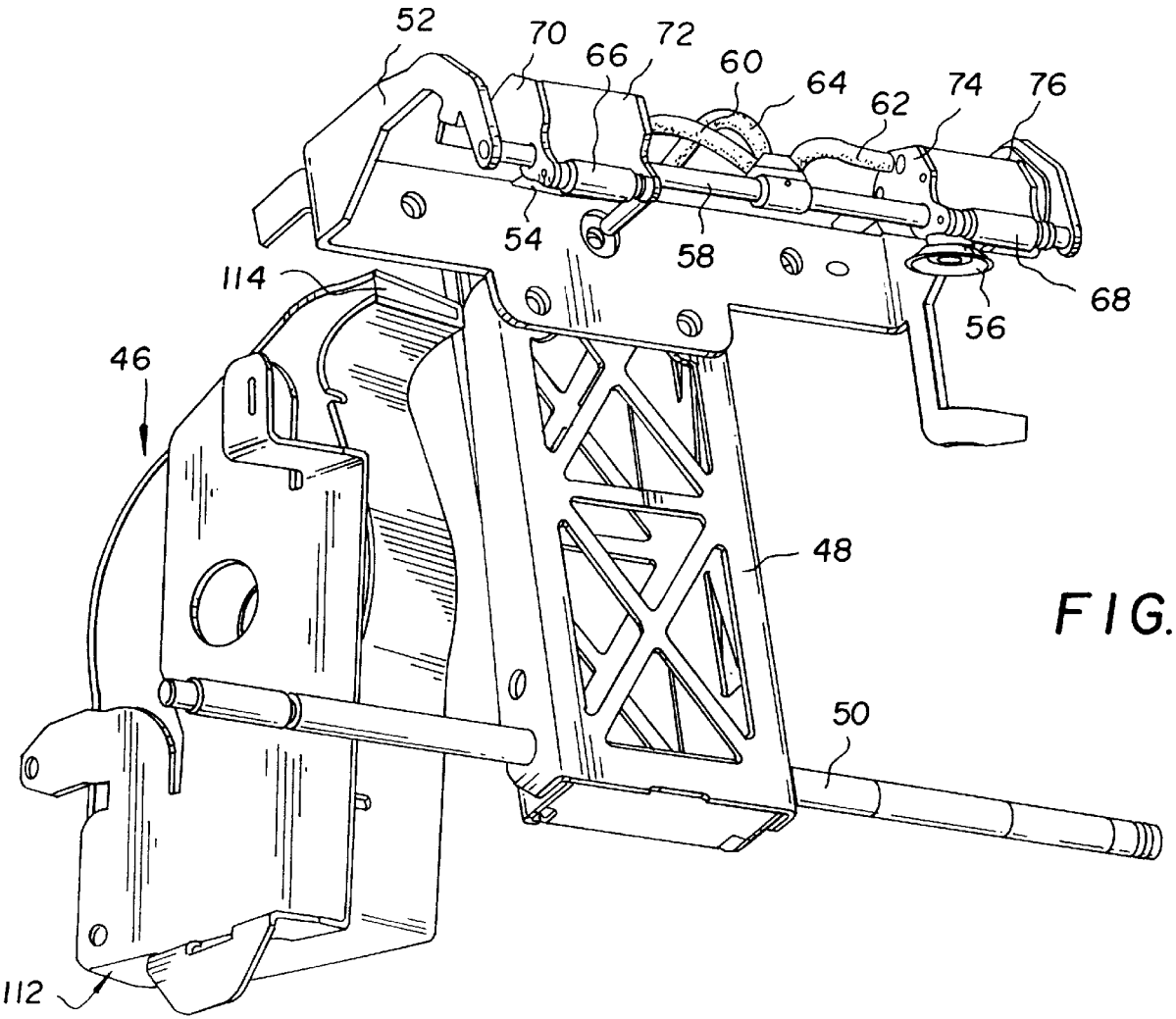
Figure 5:
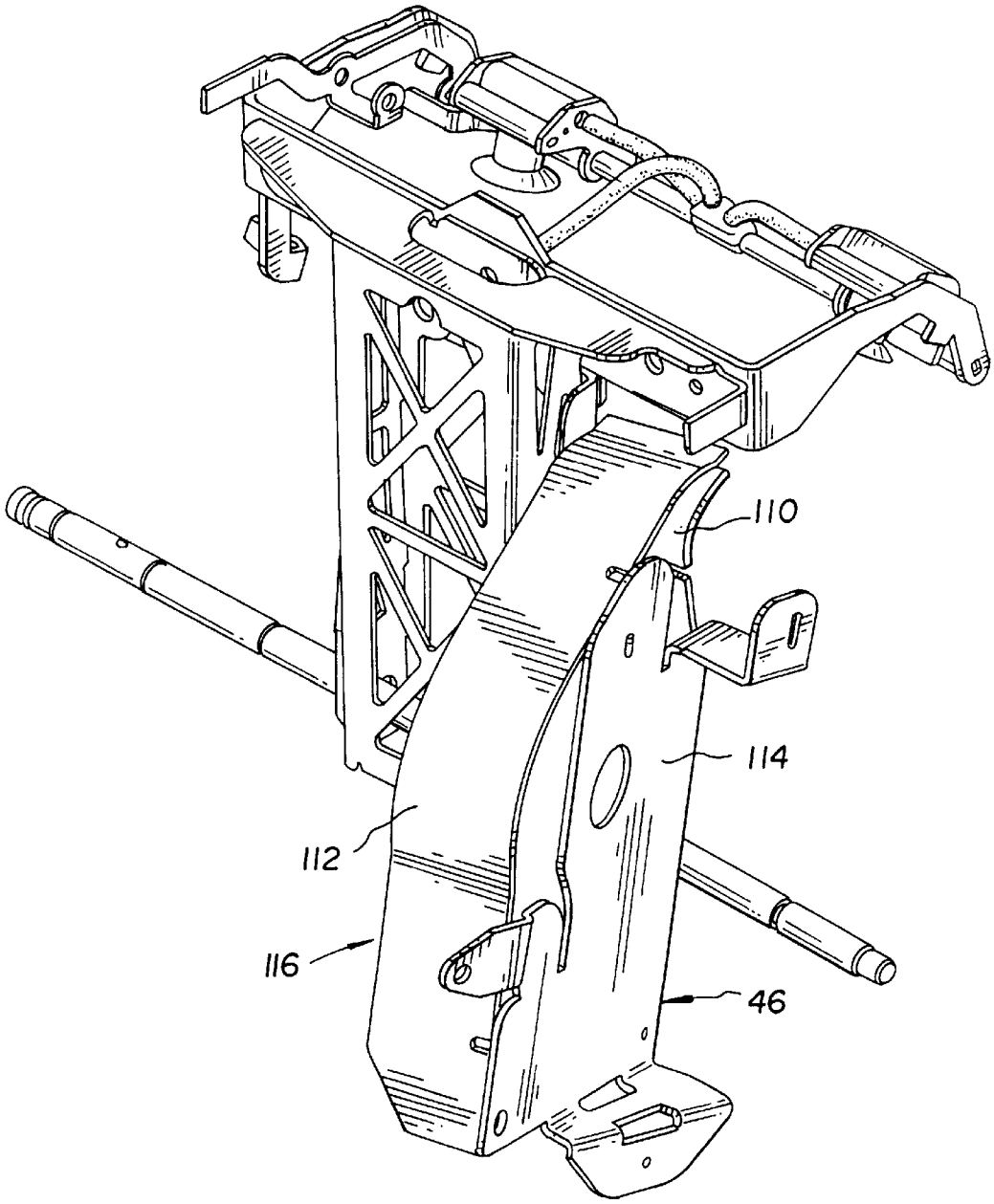
Figure 6:
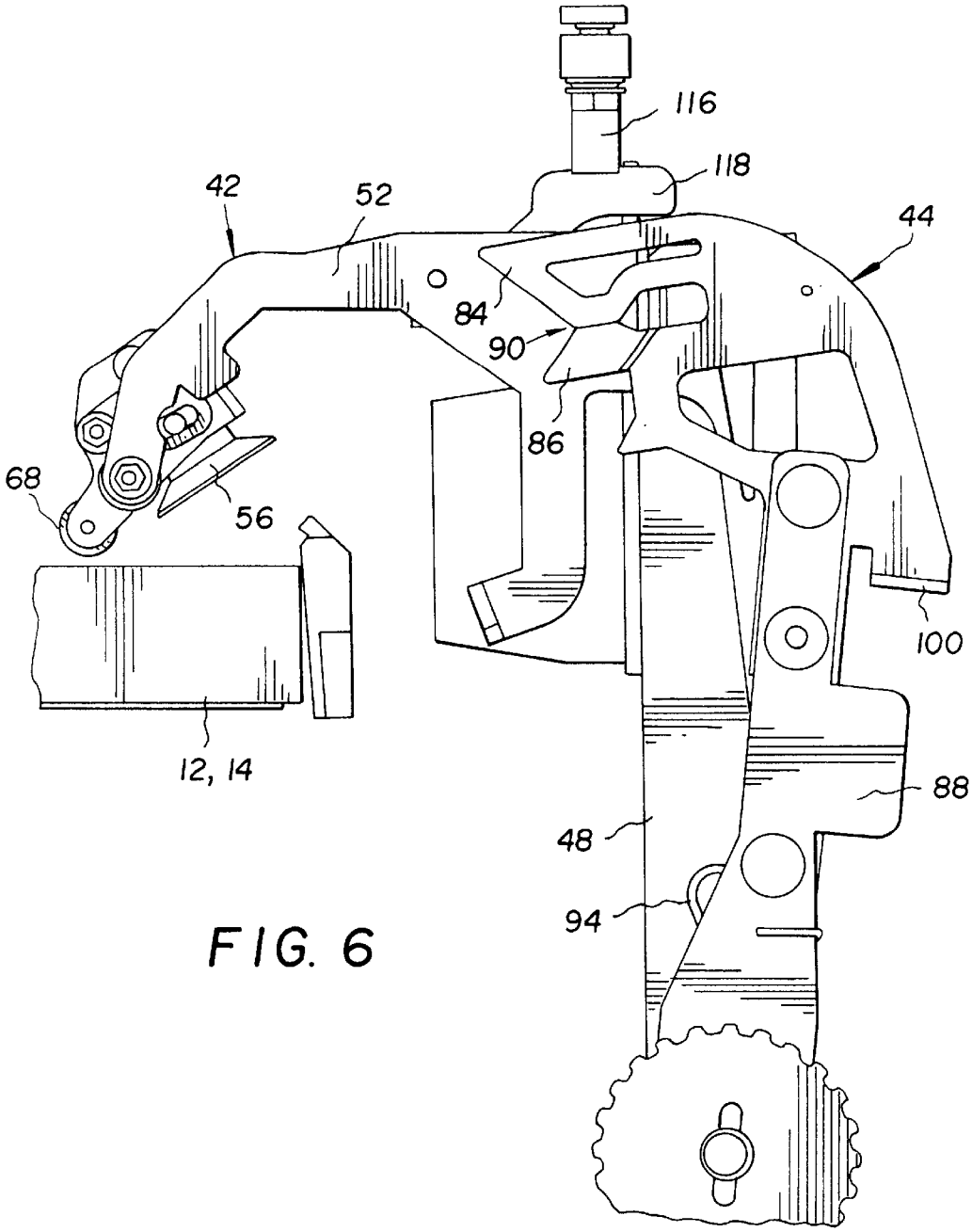
FIGS. 6–13 are elevational, diagrammatic views useful in explaining the present invention.

As shown in FIG. 6, the film sheet picker assembly 18 is moved by the elevator assembly 22 to a position relative to an open supply magazine 12,14 containing a stack of unexposed film sheets 16 that will allow the vacuum cups 54 to rotate into the magazine unobstructed.

Figure 7:
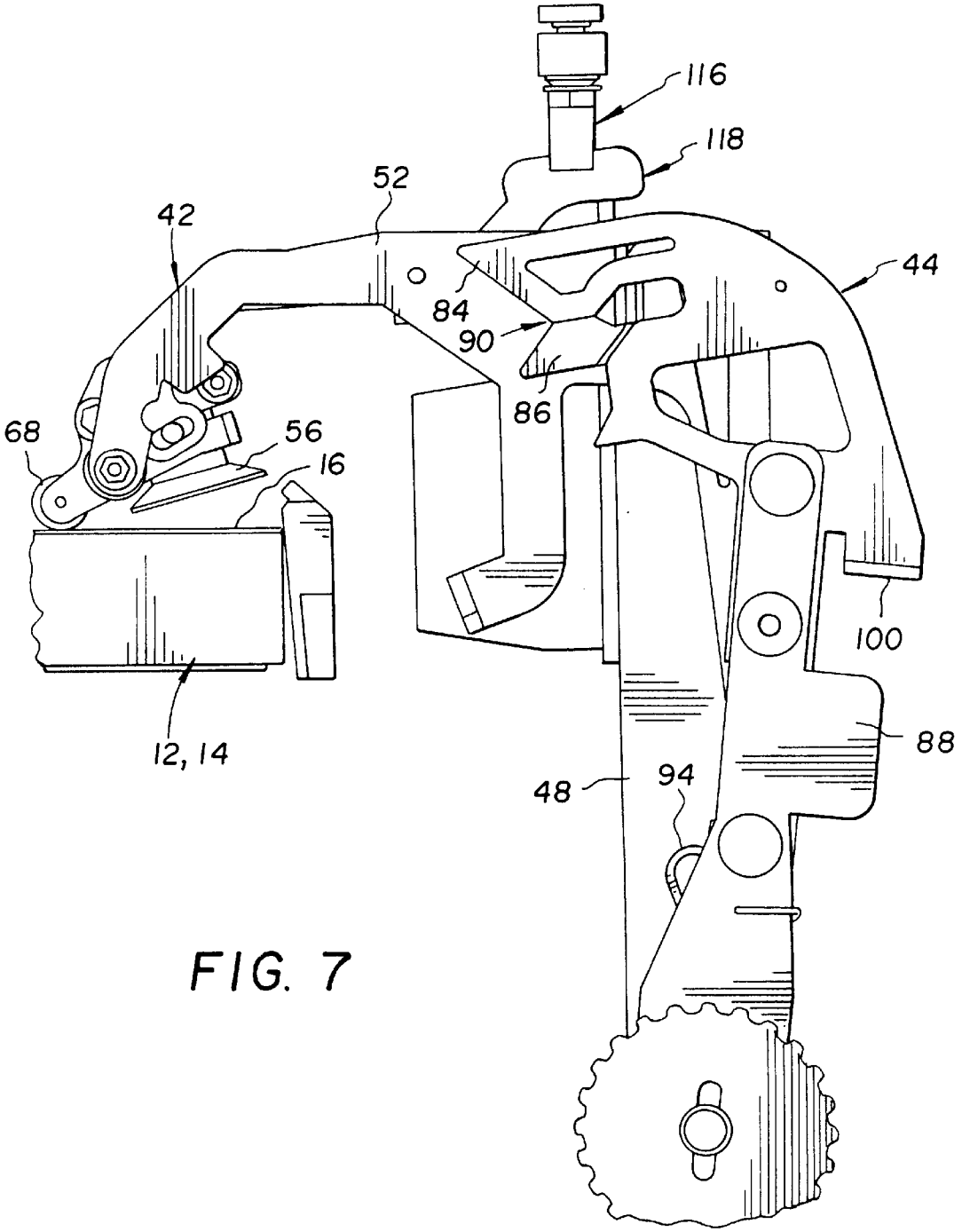

As shown in FIG. 7, picker arm assembly 42 including vacuum cups 54 is rotated into the selected supply magazine 12,14.

The elevator assembly 22 then slowly lowers the entire picker assembly 18 until a photo sensor/linkage 116,118 indicates that the picker arm 52 is in proximity with the top film sheet 16 in the magazine 12,14. Linkage 118 is rotated by rollers 64 and rocker members 58,60.

Figure 8:
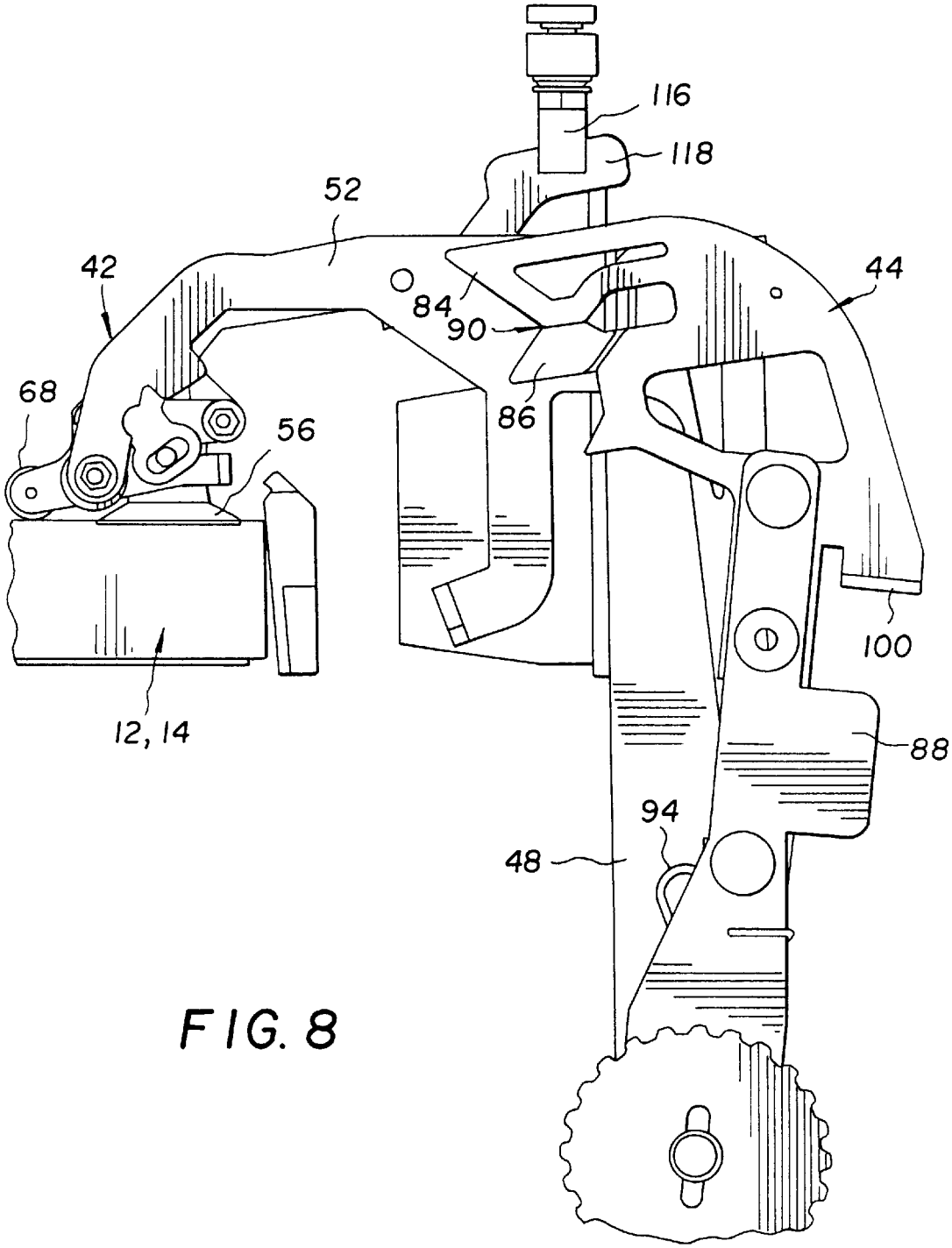

As shown in FIG. 8, upon sensing the presence of the top film sheet 16, the elevator assembly 22 will continue to move downward a predetermined number of steps (this number is calibrated at machine assembly and is referred to as "press steps") that will bring the vacuum cups 54 into full contact with the top film sheet 16 through contact of rollers 64 with top film sheet 16.

Upon completion of the press steps, the picker arm assembly 42 will utilize a vacuum switch (not shown) located within the picker assembly 18 to determine if the vacuum cups 54 have created an adequate seal with the top film sheet 16. If the seal between the cups 54 and the film sheet 16 is not sufficiently to actuate the vacuum switch, the elevator assembly 22 will lower the picker assembly 18 an additional three elevator "steps" before checking the integrity of the seal again. This procedure will be repeated up to six times before an error condition will be logged and displayed to the machine operator.

After the top film sheet 16 is secured to the vacuum cups 54, the air mover 46 (FIGS. 4,5) is signaled by the control 34 to change fan 110 from its low speed mode of operation to high speed to allow time for it to achieve maximum air flow in preparation for a film separation function that will to occur later in the picking cycle.

Figure 9:
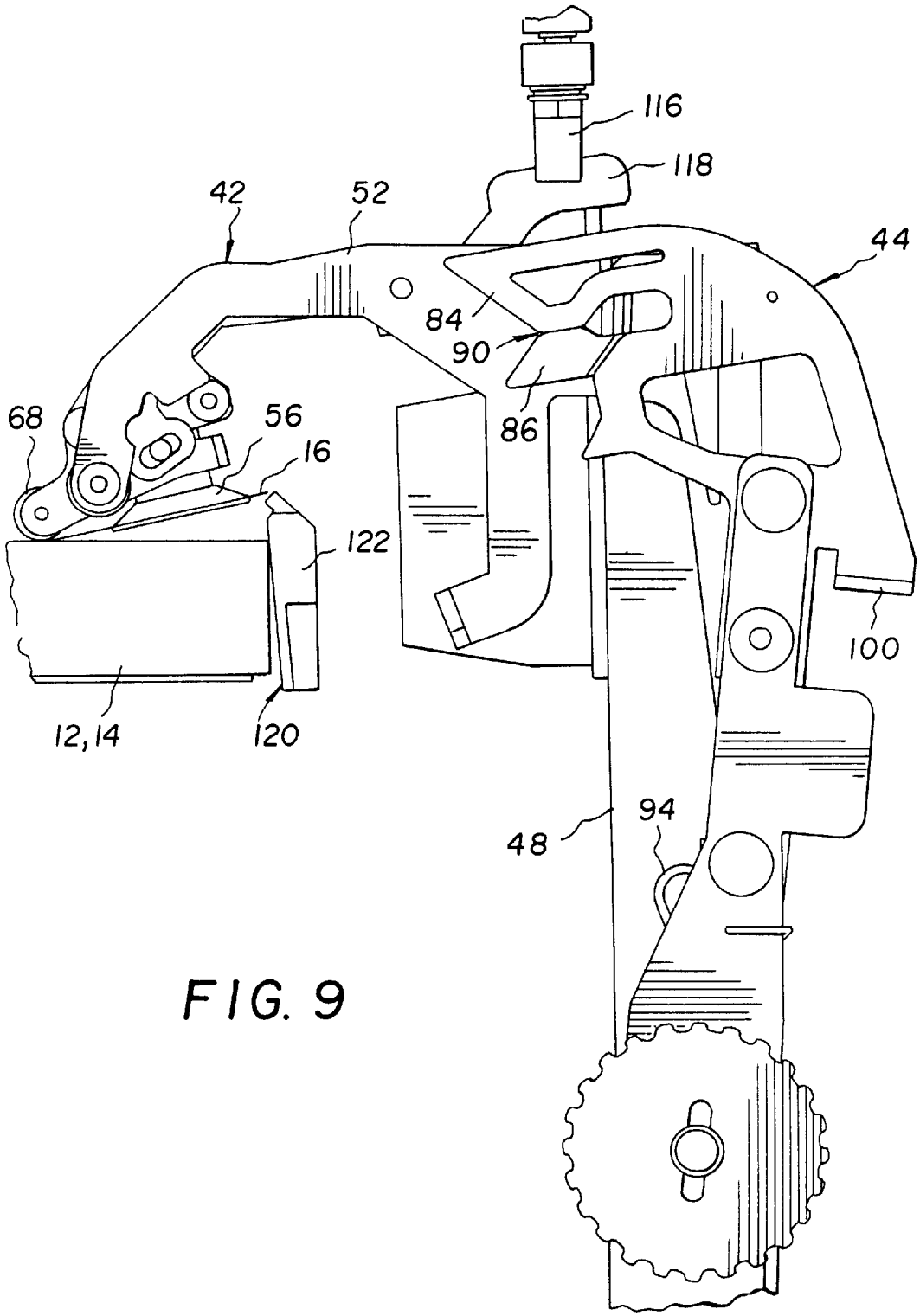

As shown in FIG. 9, the picker arm assembly 42 is then moved slightly upward by elevator assembly 22 and the torque being applied by the picker arm motor 78 is decreased to allow the reaction forces in the picker assembly 42 to drive the edge of the top film sheet 16 into surface 120 film holdbacks 122 within the supply magazine 12,14.

The picker assembly 42 is then moved higher to allow the surface 120 on the holdbacks 122 to aid separating the top film sheet 16 from the film sheet(s) 16 immediately below it.

Figure 10:
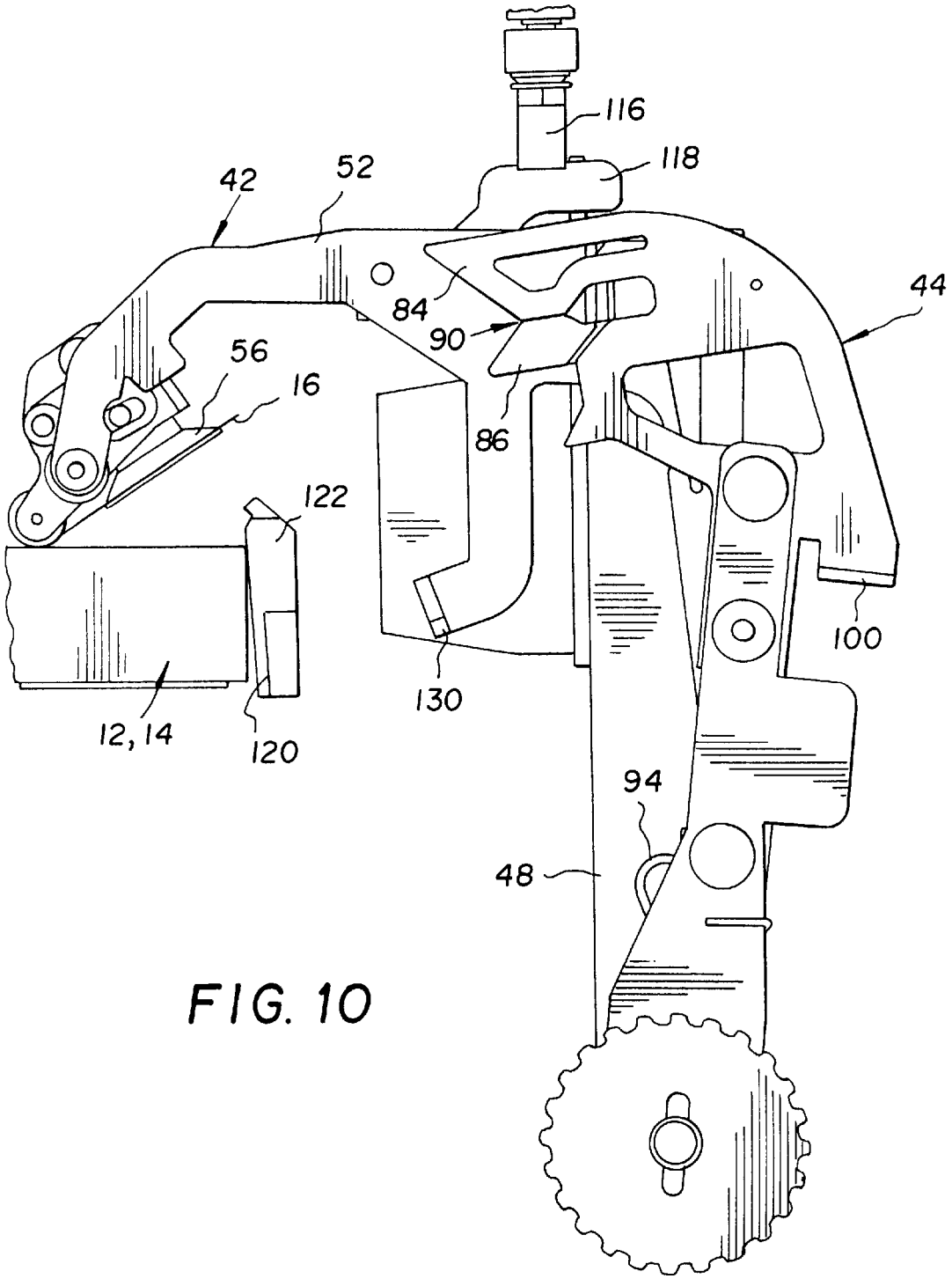

As shown in FIG. 10, the picker arm assembly 42 disengages the film sheet 16 from surface 120 as the vacuum cups 54 rotate to a 35° angle relative to the top surface of the film stack.

With the front area of film sheet 16 positioned at 35° and being supported only by the vacuum cups 54, the picker arm assembly 42 is held motionless for several seconds to allow gravity and the ambient air pressure to dislodge any film sheets 16 that may still be attached to the top film sheet 16.

Figure 11:
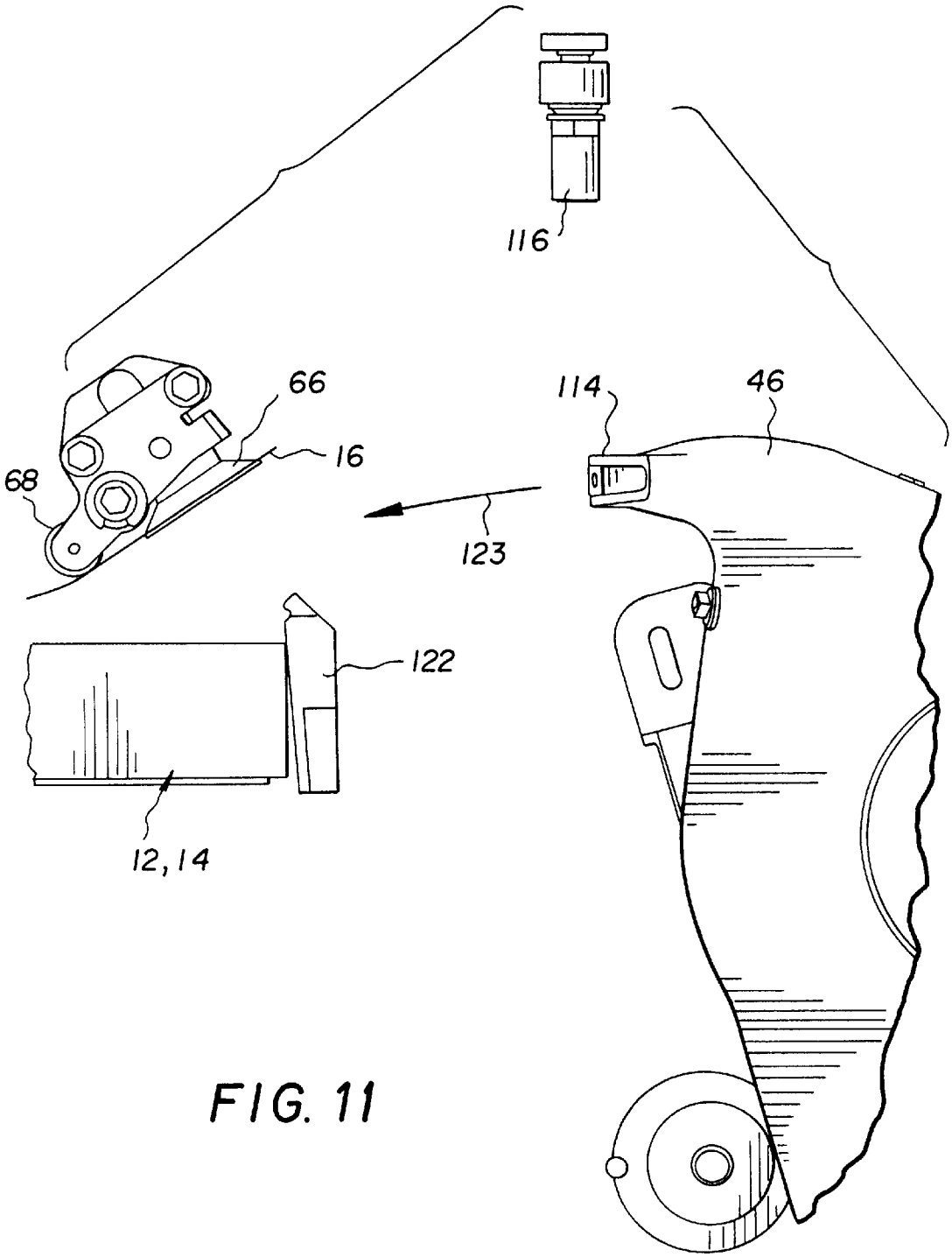

As shown in FIG. 11, at the completion of this dwell time, the picker assembly 18 is moved to allow the air flow from the air mover 46 to completely separate the film sheet 16 being held by the vacuum cups 54 from the film sheet 16 immediately below it in the supply magazine 12,14.

Figure 12:
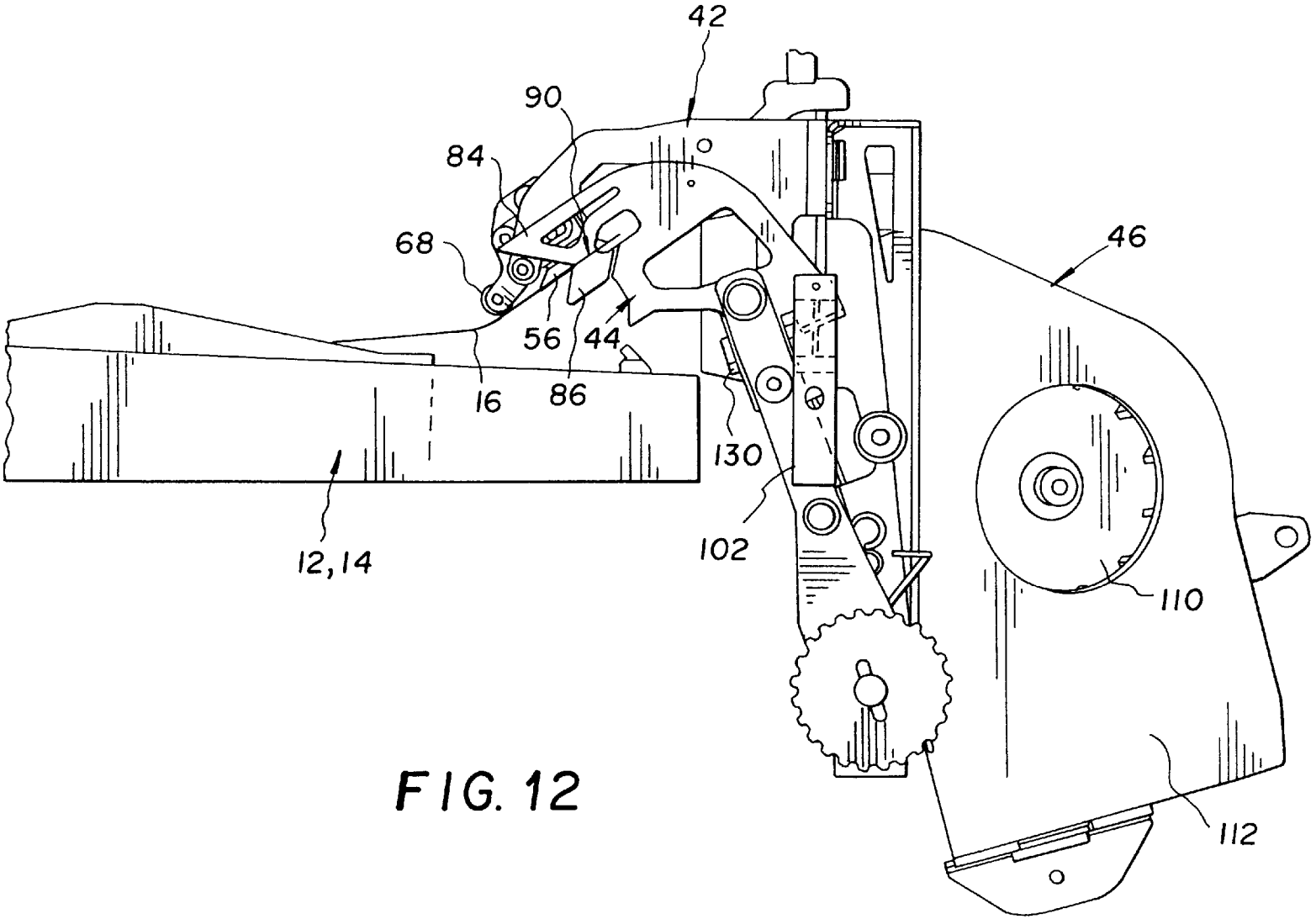

As shown in FIG. 12, at the completion of the dwell, the picker assembly 42 is then move downwardly to a position to allow the multiple sheet detector 44 to function correctly.

Upon reaching this position, the detector 44 release solenoid 96 is activated and the detector 44 is allowed to rotate into the supply magazine 12,14.

Figure 13:
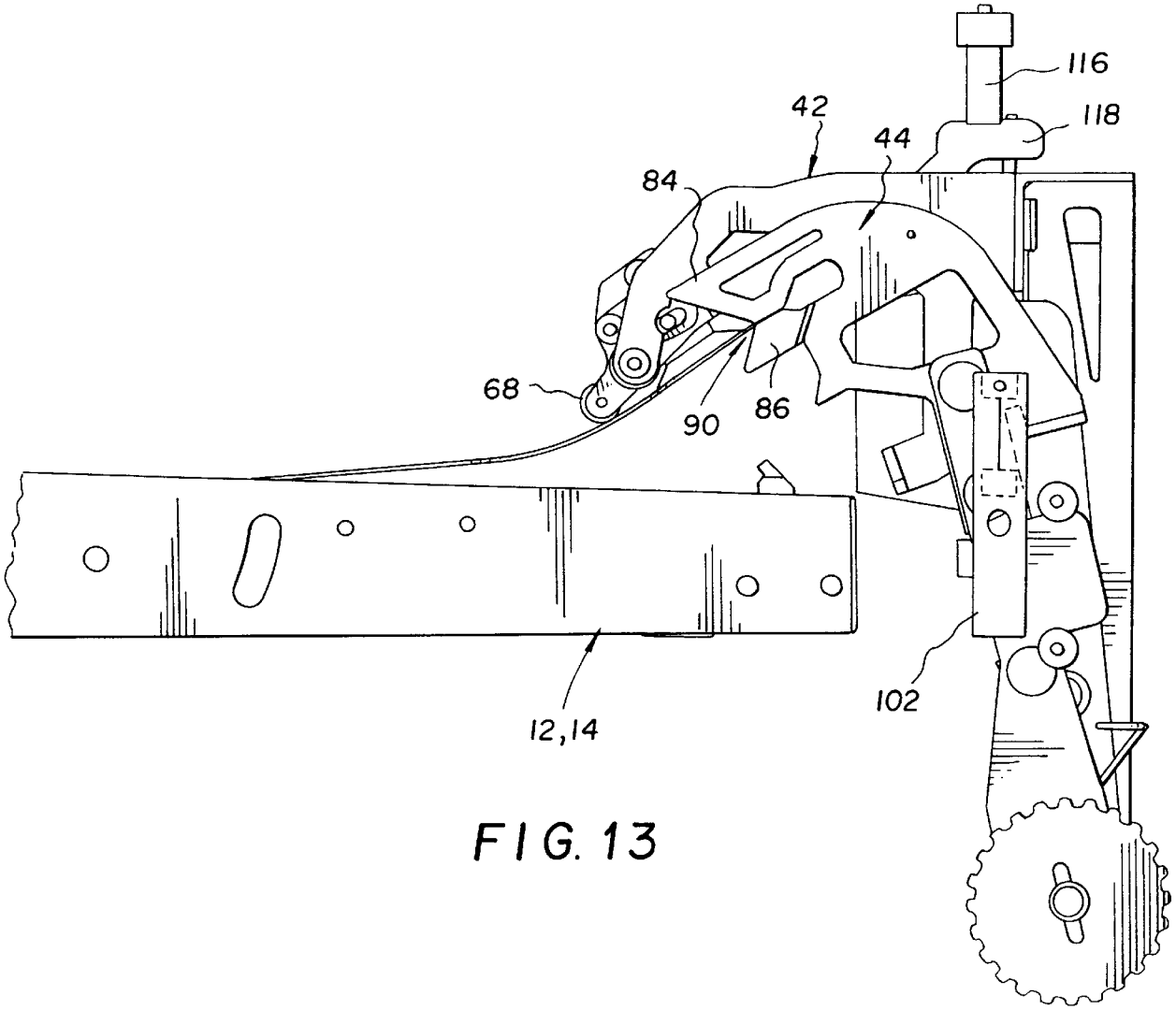

If the detector 44 encounters a single film sheet 16, film sheet 16 will pass through space 90 between jaws 84,86, and it will signal the control 34 (FIG. 14) that the attempted pick was successful and the picker arm assembly 42 will pull the film sheet 16 attached to its vacuum cups 54 into the picker assembly 18 thus removing the film sheet 16 from the supply magazine 12,14. Detector 44 will be stopped by stop 130 on assembly 42. If, however, as shown in FIG. 13, detector 44 indicates that more than one sheet 16 is being held by the vacuum cups 54 because the multiple sheets are stopped by jaws 84,86 since they fail to pass through space 90. The control 34 will remove the vacuum from the cups 54 and allow the film sheets 16 to fall back into the supply magazine 12,14. The control 34 will then begin a sequence of actions that is intended to insure that the fallen film sheets are located directly on top of the film stack and not resting on top of the film holdbacks 122.

An indication of a multiple sheet pick will allow two additional attempts to be made to achieve a pick that has only one film sheet 16 held by the vacuum cups 54. If the picker assembly is not capable of picking a single film sheet 16 from the stack after a total of three attempts, the control 34 will inform the operator of a machine malfunction and record the event in the machine's error log.

If a successful picking sequence occurred, it will be followed by the control 34 directing the elevator assembly 22 to move the picker assembly 18 upward until it is in a position that will allow the reverse rotation of the picker arm assembly 42 to transfer film sheet 16 from the picker assembly 18 to the exposure platen 28 (FIG. 14).

After the film sheet 16 is resting on the platen 28, the vacuum is removed form the vacuum cups 54 and the film sheet 16 is allowed to fall onto the platen 28.

After the picker arm assembly 42 has returned to its "home" position, the elevator assembly 22 will lower the picker assembly 18 to a supply magazine 12,14 and the picking sequence can begin again.

The invention has been described in detail with particular reference to certain preferred embodiments thereof, but it will be understood that variations and modifications can be effected within the spirit and scope of the invention.

| PARTS LIST | |
|---|---|
| 10 | imaging apparatus |
| 12,14 | supply magazine |
| 16 | film sheet |
| 18 | film sheet picker assembly |
| 19 | vertical directions |
| 20 | vertical guide |
| 22 | elevator assembly |
| 24 | sheet picker |
| 26 | suction cup |
| 28 | exposure platen |
| 30 | laser scanner |
| 32 | film processor |
| 34 | control |
| 40 | frame |
| 42 | film sheet picker arm assembly |
| 44 | multiple sheet detector |
| 46 | air mover |
| 48 | member |
| 50 | shaft |
| 52 | U-shaped member |
| 53 | arms |
| 54 | suction cups |
| 56 | shaft |
| 57 | clockwise direction |
| 58,60 | rocker members |
| 62 | plenum member |
| 64 | rollers |
| 66 | shaft |
| 68 | vacuum conduit |
| 69 | springs |
| 78 | motor |
| 80 | belt |
| 82 | sprocket |
| 84,86 | jaws |
| 88 | lever |
| 90 | space |
| 92 | arrow |
| 94 | spring |
| 96 | solenoid |
| 98 | pin |
| 100 | interrupter member |
| 102 | photosensor |
| 110 | fan |

-continued

| PARTS LIST | |
|---|---|
| 112 | chamber |
| 114 | nozzle |
| 116 | film sensor |
| 118 | linkage |
| 120 | surface |
| 122 | film holdbacks |

What is claimed is:

1. Film sheet handling apparatus comprising:

means for removing a film sheet from a film sheet stack by bending a front area of the top film sheet and then removing the top film sheet from the stack;

a pair of multiple sheet detector jaws mounted at the free end of a rotatable lever, said jaws being spaced apart a fixed distance which will allow a single film sheet but not multiple film sheets to slide between said jaws;

means for rotating said lever so that said jaws are moved into the bent front area of the top film sheet while the film sheet is still located on said stack, allowing said film sheet to slide between said jaws if a single film sheet is separated so that said lever and jaws are rotated to a first position, and blocking said jaws if multiple film sheets are contacted, so that said lever and jaws are rotated to a second position in advance of said first position; and a sensor assembly, which is stationarily mounted relative to said lever and said jaws, for selectively sensing whether said lever and jaws are rotated to said first position to indicate that only one film sheet has been separated, or to said second position to indicate that more than one film sheet has been separated.

2. The apparatus of claim 1 wherein means for rotating includes means for biasing said lever in a direction towards said first and second positions.

3. The apparatus of claim 1 wherein said sensor assembly includes a sensor which is stationary relative to said rotatable lever and jaws, and further includes a member associated with said lever, which is sensed by said sensor only when said lever and jaws are in said first position but not in said second position.

4. The apparatus of claim 3 wherein said sensor is a photosensor and said member is positioned to interrupt said photosensor when said lever and jaws are in said first position.

* * * * *